United States Patent [19]

Reynolds et al.

[11] 4,047,663

[45] Sept. 13, 1977

[54] RAIL PLATE HAVING SPRING CLIPS AND LATERAL POSITIONING MEANS

[76] Inventors: Clarke Reynolds, 535 Hillary Drive, Tiburon, Calif. 94920; Richard J. Quigley, 25538 Adobe Lane, Los Altos Hills, Calif. 94022

[21] Appl. No.: 634,166

[22] Filed: Nov. 21, 1975

[51] Int. Cl.[2] ..... E01B 9/48; E01B 9/62; E01B 9/68

[52] U.S. Cl. ..... 238/304; 238/282; 238/283; 238/349

[58] Field of Search ..... 238/349, 282, 283, 351, 238/310, 264, 287, 304

[56] References Cited

U.S. PATENT DOCUMENTS

| | | | |
|---|---|---|---|
| 1,926,088 | 9/1933 | Faries et al. | 238/304 |
| 2,076,019 | 4/1937 | Fifield | 238/349 |
| 2,127,430 | 8/1938 | Scholes | 238/304 |
| 3,439,874 | 4/1969 | Meier | 238/349 |
| 3,576,293 | 4/1971 | Landis et al. | 238/283 |
| 3,724,754 | 4/1973 | Molyneux et al. | 238/349 |
| 3,784,097 | 1/1974 | Landis | 238/282 |
| 3,934,800 | 1/1976 | Molyneux et al. | 238/282 |

FOREIGN PATENT DOCUMENTS

| | | | |
|---|---|---|---|
| 450,986 | 9/1948 | Canada | 238/287 |
| 2,032,915 | 1/1972 | Germany | 238/283 |
| 98,881 | 8/1961 | Netherlands | 238/349 |
| 385,262 | 3/1965 | Switzerland | 238/310 |
| 396,960 | 1/1966 | Switzerland | 238/349 |

*Primary Examiner*—Robert J. Spar
*Assistant Examiner*—Carl Rowold
*Attorney, Agent, or Firm*—Lowhurst & Aine

[57] ABSTRACT

A rail fastener includes a rail plate, a layer of elastomeric material between the plate and a support structure, and a pair of posts for laterally and longitudinally restraining the rail plate, with elastomeric material mounted between the posts and cooperating surfaces of the rail plate. The rail plate, the layer of elastomeric material, and the support structure on which it is mounted form a shear pad. The posts are partially embedded in the support structure and extend through respective openings in the rail plate, the inner peripheries of which are covered with elastomeric material, to provide lateral and longitudinal restraint to the rail plate. Each of these posts is preferably formed of two parts, one of which is embedded in the support structure, and the other of which is an eccentric which is releasably attached thereto. Rotation of the eccentrics provides lateral and longitudinal adjustment of the rail plate with respect to the support structures, thereby providing lateral adjustment of the rail with respect to the support structure. The elastomeric material is preferably polyurethane having a relatively high resistance to abrasion and a known, predictable and well defined coefficient of friction. The posts are of a size which eliminates the possibility of any movement thereof under any expected lateral shear loads which may be imposed on the rail plate.

8 Claims, 3 Drawing Figures

RAIL PLATE HAVING SPRING CLIPS AND LATERAL POSITIONING MEANS

BACKGROUND OF THE INVENTION

1. Field of the Invention

This invention relates generally to a rail fastener and more particularly to a fastener for holding a rail onto a support structure which provides improved electrical isolation and vibration and sound attenuation between the rail and the support structure and permits improved lateral adjustment of the rail with respect to the support structure, while maintaining structural integrity between the rail and the support structure.

2. Prior Art

Direct fixation rail fasteners have been employed extensively in recent years in place of tie-on ballast arrangements for affixing transit rail apparatus to a rigid support structure. Because of the stress conditions placed on the rail and supporting by the transit apparatus, as well as by changing environmental conditions, such as temperature, moisture, etc., direct fixation of a rail to a concrete support structure is not a simple matter. Structural integrity must be maintained between the rail and the support structure, but vibrations, including sound vibrations, which are generated in the rail must be attenuated before reaching the support structure. Direct fixation design is still further complicated by the fact that many of the transit systems are electrically energized and use the rail as the return path for the energizing electrical current, and as a result, the rails must be electrically isolated from the support structure. Also, such fasteners must be capable of permitting lateral adjustment or positioning of the rail with respect to the support structure. The most severe compromise, however, is that which must be achieved between attaining a desired amount of structural integrity between the rail and the support structure while sufficiently attenuating any vibrations which may be transmitted from the rail to the support structure.

As a rail mounted vehicle moves along a track, a differential wave is caused to build up in the rail in front of the vehicle because of the leverage action which results from the localized vertical forces applies to the rail by the wheels of the vehicle. Thus, a given portion of the rail is subjected to first an upward force as the vehicle approaches and then a downward force as the wheels roll thereover. Where the rail is directly affixed to the support structure, this wavelike motion will produce a pounding action between the rail and the supporting concrete structure which will tend to desintegrate the concrete unless some means is provided between the rail and the concrete structure to absorb the impact therebetween.

In addition to the deleterious effects on the concrete structure produced by the pounding action, undesirable sonic vibrations will be introduced to the surrounding structures. Thus, suitable means must be incorporated into the rail fastener device to absorb shock and dissipate some of the energy in order to attenuate the noise which would otherwise be transmitted into surrounding buildings and other structures.

Another problem which must be overcome in attaching a rail directly to a concrete support structure is that of maintaining gage accuracy between the rails. This is especially true in areas where the supporting structures will be subjected to sinking, earthquakes, and other uncontrollable phenomenon. Thus, means must be provided in direct fixation rail fasteners which will permit the rails to be adjusted laterally within reasonably limits. As an example, one current set of design specifications require that lateral adjustment be at least plus or minus one-eighth inch.

In addition to providing vibration attenuation and rail position capability, a rail fastener must also provide structural integrity between the rail and the support structure. However, a compromise exists between structural integrity and vibration attenuation, since structural integrity implies a relatively rigid fixation device between the rail and the support structure, while vibration attenuation implies a non-rigid fixation device. That is, a rail fastener must be sufficiently rigid to provide structural integrity between the rail on the support structure, but must be sufficiently non-rigid to be able to attenuate vibrations transmitted from the rail to the support structure. This problem is further compounded by the requirement that the fastener must be capable of permitting lateral adjustment or positioning of the rail with respect to the support structure. Such lateral positioning capability is incompatible with the requirements for structural integrity.

When a vehicle moves over a rail, in addition to the differential pressure wave discussed above, the rail will be subjected to overturning moments and shear forces, particularly in a curved portion of the track. If a rail is permitted to move laterally when lateral shear forces are imposed thereon, the gage of the track will not be maintained and the vehicle may lose contact with the rail. However, all of the known direct fixation rail fasteners which are capable of absorbing the above mentioned vertical forces do not achieve a proper balance between lateral restraint of the rail and vibration attenuation. That is, those prior known direct fixation rail fasteners which provide a sufficient amount of structural integrity between the rail and the support structure are not capable of sufficiently attenuating vibrations transmitted from the rail to the support structure. On the other hand, those direct fixation rail fasteners which are capable of sufficiently attenuating vibrations are not capable of providing a sufficient amount of lateral restraint and, therefore, structural integrity between the rail and the support structure.

In addition to the above mentioned problems encountered in the direct fixation of a rail to a support structure, prior known direct fixation rail fasteners have other disadvantages. Presently, the most widely used type of rail fastener employs a shear pad in which a layer of elastomeric material is sandwiched between two plates, with the rail being clamped to the top plate and the bottom plate being clamped to the support structure. These shear pads type of rail fasteners include structures for laterally restraining the top plate with respect to the bottom plate. Also, the majority of these rail fasteners are capable of positioning the rail laterally with respect to the support structure, but are not capable of adjusting the lateral position of the rail with respect to the support structure. Examples of such rail fasteners are disclosed in U.S. Pat. Nos. 3,576,293; 3,784,097; and 3,858,804.

The rail fasteners disclosed in these patents include a shear pad which is formed of a pair of metallic plates having a layer of elastomeric material sandwiched therebetween. The shear pad is secured to the support structure by a pair of studs and additional means are provided for laterally positioning the rail with respect to the shear pad and support structure. The lateral positioning structures disclosed in those patents include serrated members which are relatively difficult and costly to manufacture. Furthermore, this type of lateral positioning structure cannot be manipulated to laterally adjust the rail to a desired location on the shear pad. That is, these lateral positioning structures are not capable of moving the rail with respect to the shear pad and, therefore, the rail must be moved by additional means while the lateral positioning structures are being relocated. Accordingly, it can be appreciated that the lateral positioning means disclosed in the above-mentioned patents do not, in fact, adjust the lateral position of a rail, but hold the rail in a desired location after it has been positioned laterally with respect to the shear pad.

One of the problems encountered in the shear pad type of rail fastener is that of providing a sufficient amount of vibrational dampening while maintaining a desired amount of lateral restraint. The device disclosed in U.S. Pat. No. 3,576,293, laterally restrains the elastomeric layer by providing the bottom plate of the shear pad with an upturned flange for holding the lateral edges of the elastomeric layer. It was found, however, that with the incorporation of voids in the elastomeric layer to increase the vibrational dampening effect thereof, such an upturned flange did not provide the desired amount of lateral restraint to the elastomeric layer. Furthermore, lateral shear forces imposed on this upturned flange would eventually result in fracture thereof, thereby further decreasing the lateral restraint of the fastener. This problem was solved, as disclosed in U.S. Pat. No. 3,784,097, by the use of a nylon insert mounted between each anchor bolt and an edge of the upper plate of the shear pad. Any attempted lateral movement of the upper plate of the shear pad would bear against the nylon insert and impose a shear force on the anchor bolt or the sleeve surrounding it. It has been found, however, that this arrangement is unsatisfactory for a number of reasons.

Whenever attempted lateral movement of a rail imposes shear forces on a bolt or other anchor structure, such shear forces will eventually fatigue the anchoring fastener, ultimately resulting in failure thereof. In addition, such an arrangement does not provide a sufficient amount of vibration and sound attenuation between the rail and the support structure. Such a nylon insert, or any other noncompliant insert, transmits noise and other vibrations with relatively little attenuation. As previously mentioned, one of the requirements of such rail fasteners is to attenuate such noise to an acceptable level so that such noise will not be transmitted into the surrounding ground and to adjacent building.

Furthermore, the anchoring bolts of a fastener usually place the concrete which is in immediate contact therewith in tension when they are tightened to hold the fastener onto the concrete support structure. That is, these anchoring bolts are pulling the fastener and the concrete support structure together, thereby placing a portion of the concrete structure in tension. Any vibrations transmitted through the anchoring bolts to the concrete add transient forces to the pretensioned concrete. Such tensioning of the concrete around the anchoring bolts or the inserts to which they are threaded contributes to its ultimate fatigue. Pulverization of the concrete support structure in which the anchoring bolts are attached will eventually weaken that attachment. As that attachment weakens, the anchoring bolts will have greater freedom of movement, thereby further increasing the pulverization of the concrete support structure. Such movement of the anchoring bolt will also lead to fatigue thereof, with the end result being that either the anchoring bolt will fracture or the support structure will eventually lose its grip thereon.

In an attempt to overcome this problem, prior known rail fasteners employ the technique of clamping the bottom plate of the shear pad as tightly as possible to the surface of the support structure so that relatively little or no movement will exist when extreme lateral shear loads imposed thereon. However, this clamping of the bottom plate of the shear pad to the support structure does not eliminate the transmission of vibrations therethrough. Furthermore, tightly clamping the bottom plate of the shear pad to the supporting structure further increases the tension produced in that portion of the concrete support which grips either the anchoring bolt or the insert in which it is threaded.

In a further attempt to overcome this problem and in addition to clamping the bottom plate of the shear pad to the support structure, additional means have been provided for compressing the elastomeric layer, such clamping of the elastomeric layer reduces its ability to attenuate sound and other vibrations, with the result that such vibrations will be transmitted to the anchoring fastener and the support structure.

Others have attempted to solve the problem of attenuating vibrations produced by vertically directed forces by placing a layer of elastomeric material such as rubber, directly between a rail plate and the concrete support structure. However, all of these attempts have a direct connection between the rail plate and the support structure which provides structural integrity between the rail and the support structure, but does not attenuate any vibrations which are transmitted from the rail, through the rail plate and the anchoring devices to the support structure. These devices are not, in fact, shear pads, since they do not permit even a limited amount of lateral movement of the rail plate with respect to the support structure. In the absence of such lateral movement, and because of the direct connection between the rail plate and the support structure, vibrations are not attenuated. In effect, this type of rail fastener is only capable of dampening those vibrations which are the result of vertical forces applied to the rails by the wheels of the vehicle passing thereover. All of the prior known fasteners of this type have employed an elastomeric material such as rubber which is highly abrasive. As a result, this type of rail fastener has not proven satisfactory in use over a prolonged period of time because of the ultimate destruction of the elastomeric layer. An example of such a fastener is disclosed in U.S. Pat. No. 2,146,341.

The shear pad type of rail fastener is also subject to a loss of structural integrity between the rail and the support structure due to failure of one or more parts thereof. In the shear pad type of rail fastener, it has been the practice to provide voids in that portion of the elastomeric layer which is directly beneath the rail, such that its dampening effect on vibrations will be increased. The portions of the elastomeric material, however, which extend to the edges of the rail plate are not so relieved. As a result, whenever a load is placed on the rail, the rail plate will bow, since the edges thereof are held from downward movement by the solid elastomeric material, whereas the center portion thereof which is beneath the rail is permitted to move vertically. Continuous flexure of the rail plate will eventually result in its becoming fatigued. Many of the prior known fasteners of the shear pad type provide slots or other openings in the rail plate for receiving other members therein, such as clamping bolts. The absence of material in these areas further increases the likelyhood of structural failure of the rail plate under such flexural conditions.

It has also been the practice in the past to bond the elastomeric material to the surface of any elements which join the top and bottom plates of the shear pad. The elastomeric material at those areas will eventually fail under prolonged and repeated flexure of the rail plate. Such failure of the elastomeric material at those areas also reduces the structural integrity of the rail fastener.

As previously mentioned, many of the prior known rail fasteners of the shear pad type are provided with openings in the rail plate for receiving clamping elements, for example, therein. Usually these openings extend through the elastomeric layer to the bottom plate of the shear pad. These openings provide pockets for accumulating debris which may eventually form an electrical contact between the rail plate and the bottom plate of the shear pad. Since present day rail fasteners are required to provide electrical insulation between the rail and the support structure, such accumulation of debris can destroy the electrical insulation capability of a rail fastener.

SUMMARY OF THE INVENTION

It is, therefore, a primary object of the present invention to provide a rail fastener which provides a sufficient amount of structural integrity between a rail and a supporting structure and also provide a sufficient amount of attenuation to any vibrations which may be transmitted from the rail to the support structure.

A further object of the present invention is to provide such a rail fastener which employs a layer of elastomeric material which is in direct contact with the surface of the supporting structure and does not require the use of a bottom plate for maintaining structural integrity between the rail and the support structure.

Still another object of the present invention is to provide such a rail fastener in which the rail plate thereof is not subject to flexure.

A related object of the present invention is to provide such a rail fastener in which the rail plate thereof is permitted to move in its entirety in a downward vertical direction with applied loads.

Still another object of the present invention is to provide such a rail fastener without any openings therein which may be capable of accumulating debris, thereby eliminating the possibility of electrical contact between the rail and the support structure.

Yet another object of the present invention is to provide such a rail fastener in which there is no direct contact between the rail plate and the lateral restraining elements thereof.

Still a further object of the present invention is to provide a rail fastener having a lateral adjusting device which is capable of translating the rail attached thereto in a lateral direction with respect to a support structure.

A related object of the present invention is to provide such a rail fastener which can be easily and quickly adjusted in a lateral direction with respect to a support structure.

These and other objects of the present invention are attained by a rail fastener which employs a rail plate and a layer of elastomeric material secured thereto which, when attached to the support structure, forms in combination with that support structure a shear pad. In addition a pair of posts attached to the support structure provide lateral restraint to the rail plate, but do not substantially restrain vertical movement thereof in a downward direction. As a result, the rail plate is not subject to flexure.

A feature of the present invention resides in the provision of a layer of elastomeric material between edges of the rail plate and the posts, which layer attenuates vibrations which may be transmitted from the rail into the rail plate.

Another feature of the present invention resides in the provision of eccentrics as the lateral restraint posts, which eccentric can be rotated to laterally position the rail plate and rail with respect to the supporting structure.

Still a further feature of the present invention resides in the provision of relatively large cross sectional area posts for laterally restraining the rail plate, such that a bottom plate is not needed. That is, these lateral restraining posts are of a size which will eliminate any movement thereof under any expected lateral shear forces imposed thereon in the absence of a bottom plate.

The invention, however, as well as other objects, features and advantages thereof will be more fully realized and understood from the following detailed description, when taken in conjunction with the accompanying drawing, wherein:

BRIEF DESCRIPTION OF THE DRAWING

Like reference numerals throughout the various views of the drawing are intended to designate the same elements.

DETAILED DESCRIPTION OF THE PREFERRED EMBODIMENT

Figure 1:
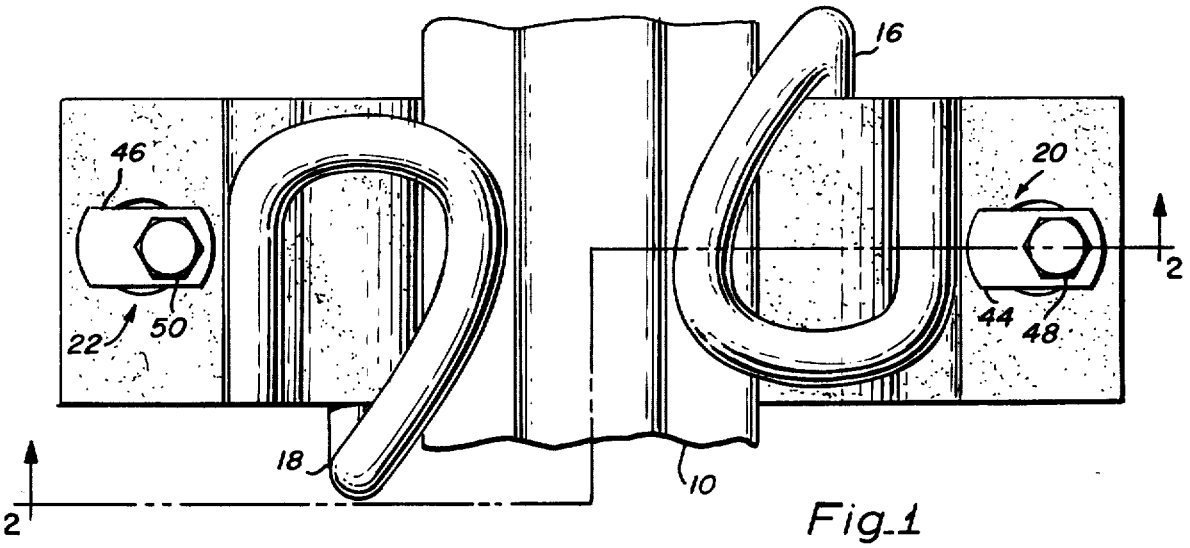
FIG. 1 is a plan view of a rail fastener constructed in accordance with the principles of the present invention.
Figure 2:
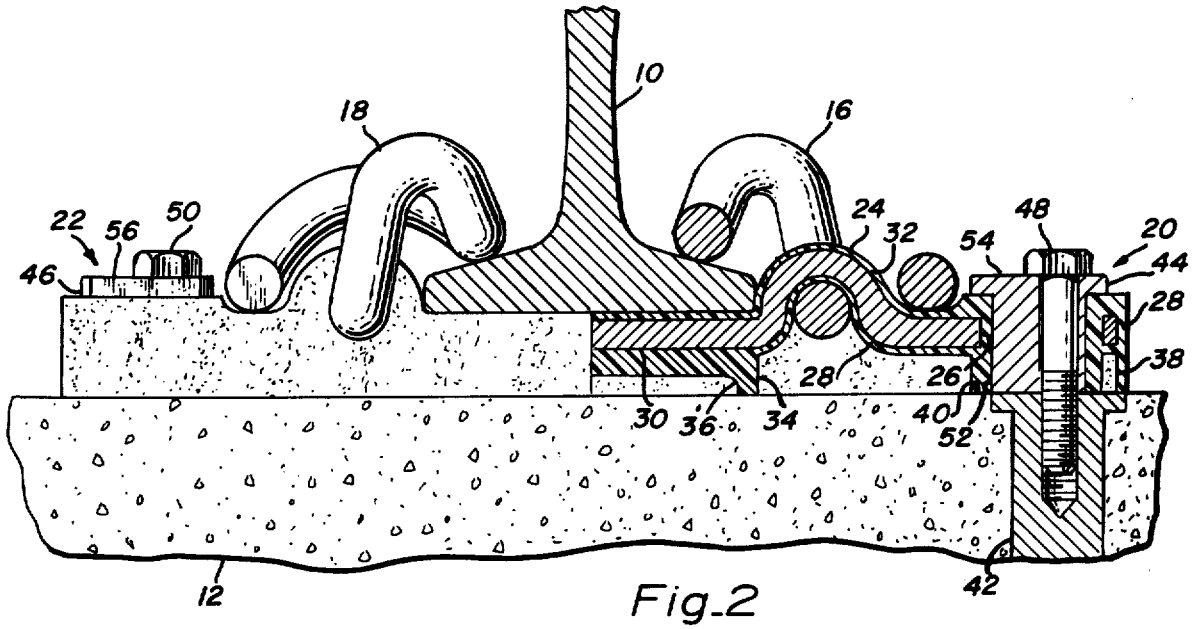
FIG. 2 is a partial sectional view taken generally along line 2—2 of FIG. 1.

With reference to FIGS. 1 and 2, there is shown a rail fastener which is constructed in accordance with the principles of the present invention for holding a rail 10 onto a support structure 12, such as a concrete slab. The fastener generally includes a base 14, a pair of Pandrol clips 16 and 18, and a pair of lateral restraining and adjusting elements, generally designated with the reference numerals 20 and 22.

The base 14 is formed of a rail plate 24 which is provided with a pair of openings 26 on opposite sides thereof for receiving the elements 20 and 22 therein. The rail plate 24 is covered on all of its surfaces, including the inner peripheries of the openings 26, with a layer of elastomeric material 28 which has different degrees of hardness or softness to accomplish the different functions explained hereinbefore. The rail plate 24 is preferably of a metallic material, and the elastomeric material 28 is preferably polyurethane.

The rail plate 24 has a central portion 30 thereof which is disposed for supporting the rail 10 thereon. Also, the rail plate 24 is formed with a pair of U-shaped sections 32, one of which is shown in FIG. 2, which are contiguous with the central portion 30 and provide shoulders for bearing against and laterally restraining the lower flanges of the rail 10. The U-shaped sections 32 are disposed for receiving one end of the Pandrol clips 16 and 18, respectively, therein. The other end of each of the Pandrol clips 16 and 18 is disposed for bearing against an upper surface of the rail plate 24 with the layer of elastomeric material 28 therebetween. This portion of the layer serves no particular function, except to protect the rail fastener against deterioration by the elements, and therefore may be either soft or hard. A center section of each of the Pandrol clips 16 and 18 is disposed for bearing against a respective one of the lower flanges of the rail 10. The Pandrol clips 16 and 18 are dimensioned such that when they are inserted into the U-shaped sections 32 and bear against the lower flanges of the rail 10, they are in a flexed state, or in a state of compression. Accordingly, it can be appreciated that the Pandrol clips 16 and 18 clamp the rail 10 onto the plate 14. Furthermore, any transient loads which tend to lift the rail 10 off the base 14 will be absorbed by flexure of the Pandrol clips 16 and 18. The layer of elastomeric material 28 which is between the bottom surface of the rail 10 and the rail plate 24 provides a known, predictable, and well defined coefficient of friction between the rail 10 and the base 14.

One of the problems encountered in prior known rail fasteners is that of having the rail mounted on a surface of the fastener which does not have a known, predictable, and well defined coefficient of friction. This is the case when the rail is mounted on a steel plate, for example. The coefficient of friction of steel-on-steel is not well defined and predictable and may vary over a relatively large range. As a result, it has been possible with prior known rail fasteners for the rail 10 to move longitudinally thereon, when such longitudinal movement is not desired. The present invention overcomes this problem by providing a layer of elastomeric material, which is preferably polyurethane, between the rail plate 24 and the bottom surface of the rail 10. To fulfill this particular function, this portion of the polyurethane layer will have to be relatively hard or else it would neither have a predictable and well defined coefficient of friction nor a relatively high resistance to abrasion.

Figure 3:
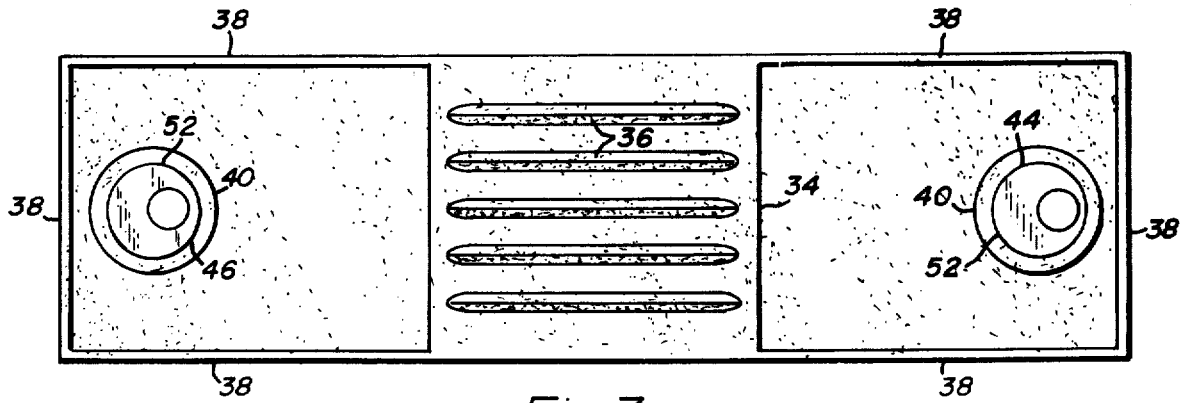
FIG. 3 is a bottom view of the rail fastener base illustrated in FIGS. 1 and 2.

The elastomeric material 28 includes a relatively thick layer 34 which is secured to an underside of the central section 30 of the rail plate 24. As shown in FIGS. 2 and 3, the layer 34 has dimensions which correspond to the width of the lower flanges of the rail 10 and the width of the base 14. The layer 34 is provided with a plurality of voids 36 which permit it to compress when vertical loads are placed thereon. In addition, a skirt of elastomeric material 38 is provided around the outer periphery of the rail plate 24 and extends to an upper surface of the support structure 12. A similar skirt 40 extends from the layer of elastomeric material which is mounted on the inner peripheries of the openings 26 to a surface of the support structure. The elements 20 and 22 extend through the openings in the skirt 40.

Each of the lateral restraining and adjusting elements 20 and 22 includes an insert 42 which is embedded in the concrete support structure 12, with an upper surface thereof being flush with the upper surface of the support structure 12. The elements 20 and 22 also include eccentric members 44 and 46, respectively each having an aperture therethrough for receiving bolts 48 and 50, respectively, which are in threaded engagement with the inserts 42. The eccentrics 44 and 46 each include a cylindrical portion 52 which is received in the openings of the elastomeric material which surrounds the inner peripheries of the openings 26 and the portion of the layer must be relatively hard to allow the accurate lateral positioning of the rail plate and the accurate maintaining of the gauge distance between the rails. In addition, the eccentrics 44 and 46 include cylindrical flange portions 54, and 56, respectively, which are integral with a respective cylindrical portion 52 and are each provided with a pair of flats thereon, such that they can be rotated by a wrench, for example. The shoulders provided between the cylindrical flange portions 54 and 56 and the cylindrical portions 52 bear against the elastomeric material 28 which surrounds the peripheries of the openings 26 in the rail plate 24. The length of the cylindrical portions 52 is equal to the depth of the apertures through the elastomeric material 28 when the elastomeric material is in an uncompressed state. This, of course, requires the portion of material 28 between the upper surface of rail plate 24 and the lower surface of flanges 54 and 56 to be relatively hard so that the rail plate is limited to downward displacement only from the uncompressed state, else it would be lifted off the support if upward forces could produce an upward displacement. Accordingly, when the bolts 48 and 50 are completely tightened, the base 14 is restrained from being lifted off the support structure 12 and the elastomeric material surrounding the eccentrics 44 and 46 is constrained, but it is not compressed.

When the bolts 48 and 50 are loosened, the eccentrics 44 and 46 can be rotated around an axis of the apertures therethrough which receive the bolts 48 and 50. Rotation of the eccentrics 44 and 46 moves the base 14 and the rail 10 in a lateral direction with respect to the support structure 12. After the eccentrics 44 and 46 have been rotated to position the base 14 with respect to the support structure 12, the bolts 48 and 50 are tightened, such that the eccentrics 44 and 46 will be held in their respective positions. This positioning of the base 14 with respect to the support structure 12 is customarily performed before the Pandrol clips 16 and 18 are mounted on the base 14. While the rail 10 is on the base 14, but before the Pandrol clips 16 and 18 are mounted thereon, it will move with the base 14 during rotation of the eccentrics 44 and 46 because of the engagement of the U-shaped sections 32 with the lower flanges thereof. After the base 14 has been properly positioned in a lateral direction with respect to the support structure 12, the bolts 48 and 50 are tightened and the Pandrol clips 16 and 18 are mounted on the base 14 to engage the lower flanges of the rail 10.

Pandrol clips 16 and 18 are mounted on the base 14 by driving respective ends thereof into the voids defined by the U-shaped portions 32 with a sledge hammer, for example. Once the Pandrol clips 16 and 18 have been mounted on the rail plate 24 and are in engagement with the lower flanges of the rail 10 in a compressed state, any subsequent longitudinal movement of the rail 10 with respect to the base 14 is restrained by the frictional engagement of the Pandrol clips 16 and 18 with the lower flanges of the rail 10 and the frictional engagement between the bottom surface of the rail 10 and the base 14. If the base 14 cannot move longitudinally with respect to the rail 10, the eccentrics 44 and 46 cannot be rotated a significant amount. Accordingly, if the bolts 48 and 50 should loosen after installation, the longitudinal restraint provided by the Pandrol clips 16 and 18 will tend to hold the eccentrics 44 and 46 in their approximate positions, thereby maintaining the lateral position of the base 14 with respect to the support structure 12. That is, Pandrol clips 16 and 18 serve the dual function of not only holding the rail 10 onto the base 14, but restraining longitudinal movement of the rail 10 with respect to the base 14, thereby locking the eccentrics 44 and 46 in their desired positions.

The inserts 42 and the eccentrics 44 and 46 effectively form posts for laterally restraining the base 14. It can be appreciated that if it is necessary for the elements 20 and 22 to provide lateral adjustability, these posts can be formed as one piece. The posts formed by the inserts 42 and the eccentrics 44 and 46 have a cross sectional area which is sufficient to eliminate the possibility of any movement thereof whenever any expected lateral shear forces are imposed thereon. That is, any lateral shear force which can be expected under maximum loading conditions will not bend or move the eccentrics 44 and 46 after they have been locked in position by the bolts 48 and 50, respectively.

The provision of a relatively large cross sectional area for the elements 20 and 22 eliminates the possibility of fracture thereof due to continuous bending under applied load conditions. Also, the mating surfaces between the cylindrical portions 52 and the inserts 42 are of a sufficient area such that the frictional forces therebetween when held by normal force imposed thereon by the bolts 48 and 50 is greater than any expected lateral load forces. Also, the provision of elastomeric material between the rail plate 24 and the eccentrics 44 and 46 attenuates sound and other vibrations. As a result, these vibrations will be sufficiently attenuated at the surface of the support structure 12 to eliminate the possibility of such vibrations causing pulverization thereof. By completely enclosing the rail plate 24 with the layer 28 of elastomeric material, adverse effects on the rail plate 24, such as the adverse effects of the environment are eliminated.

It will be noted that the rail plate 24 will not bend under any imposed vertical loads thereon. That is, since the layer 34 of elastomeric material is provided only in that area which is directly below the rail 10, the remaining portions of the rail plate 24 are relatively free to move in a vertical direction under vertical loads imposed thereon. The skirts 38 and 40 are relatively free to compress, since they are unrestrained, thereby permitting the ends of the rail plate 24 to move freely in a downward direction. Accordingly, the lateral restraining elements 20 and 22 do not restrain vertical movement of the rail plate 24 in a downward direction. Also, since the Pandrol clips 16 and 18 absorbe the majority of the upward forces imposed by the base 14 on the restraining elements 20 and 22.

It will be noted that the rail fastener of the present invention does not have any voids therein for the accumulation of any debris which may produce an electrically conductive path between the rail 10 and the support structure 12. The voids which exist on the underside of the base 14 are enclosed and protected by the skirt 38. Furthermore, the absence of such voids increases the structural integrity of the fastener of the present invention. That is, there are no openings in the plate 24 which are unsupported, thereby providing a high degree of structural integrity to the rail plate 24. Any lateral shear forces which are imposed on the lateral restraining elements 20 and 22 will be completely absorbed and transmitted to the inserts 42 without fatiguing any of the parts of the fastener. Furthermore, any vibrations are attenuated both by the elastomeric material between the restraining elements and the rail plate 24 and by the layer 34 of elastomeric material. Accordingly, it can be appreciated that the fastener of the present invention provides not only structural integrity between the rail 10 and the support structure 12, but attenuation of vibrations therebetweeen. The rail fastener of the present invention provides these advantages without the use of a bottom plate. Accordingly, the base 14 of the present invention, by its self, does not constitute a shear pad until it is attached to the support structure 12. That is, the base 14 and support structure 12 in combination with one another form a shear pad for supporting the rail 10.

The invention claimed is:

1. A fastener for supporting a rail on a support structure comprising:

a rail plate having an upper surface for supporting the rail;

clip means connected to said rail plate for resiliently clamping the rail to said rail plate, said clip means being shaped and located to allow said rail to rise above said rail plate under the application of an upwardly directed force applied to said rail;

a layer of elastomer material mounted between said rail plate and the support structure; and a pair of post means connected to the support structure, each post means being in vertically slidable engagement with said rail plate for laterally restraining said rail plate with respect to said support structure, and having a collar in nonclamping vertical engagement with said rail plate for allowing said rail plate to freely float upon said first layer of elastomer material in the uncompressed state when said rail plate is unloaded and defines a no-load level and for precluding said rail plate from rising above said no-load level while permitting the rail plate to move downwardly under the application of a downwardly directed force applied to said rail.

2. A fastener in accordance with claim 1 further including insulative material mounted between respective edges of said rail plate and said post means.

3. A fastener in accordance with claim 2 in which said insulative material is secured to said rail plate and is in slidable engagement with a respective one of said post means.

4. A fastener in accordance with claim 1 in which each of said post means includes an insert embedded in the support structure, an eccentric mounted for rotation on said insert and including said collar, and anchor bolts for clamping said eccentric firmly against said insert thereby releasably restraining vertical and rotational movement of said eccentric.

5. A fastener in accordance with claim 1 in which said layer extends only over the portion of said rail plate underlying the foot of the rail and the portions adjacent said pair of post means.

6. A fastener in accordance with claim 5 in which said layer also extends along the periphery of said rail plate.

7. A fastener in accordance with claim 1 in which said rail plate includes a well dimensioned to accommodate the rail and secure the rail against lateral movement, the sides forming said well being formed by bows of generally U-shaped configuration in the tie plate, and said clip means being anchored in the channel formed in the underside of said rail plate by said bows.

8. A fastener in accordance with claim 1 in which friction means are secured to the portion of the rail plate underlying the rail.

* * * * *